US009946216B2

(12) United States Patent
Okayasu et al.

(10) Patent No.: US 9,946,216 B2
(45) Date of Patent: Apr. 17, 2018

(54) IMAGE FORMING APPARATUS

(71) Applicant: CANON KABUSHIKI KAISHA, Tokyo (JP)

(72) Inventors: Kohei Okayasu, Mishima (JP); Shinsuke Kobayashi, Yokohama (JP); Takaaki Akamatsu, Yokohama (JP); Kenji Shindo, Yokohama (JP); Hiroki Sasame, Ichikawa (JP); Takuya Hayato, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/298,546

(22) Filed: Oct. 20, 2016

(65) Prior Publication Data

US 2017/0115622 A1 Apr. 27, 2017

(30) Foreign Application Priority Data

Oct. 27, 2015 (JP) ..... 2015-210512
Aug. 2, 2016 (JP) ..... 2016-151730

(51) Int. Cl.
*G03G 21/00* (2006.01)

(52) U.S. Cl.
CPC ..... *G03G 21/00* (2013.01)

(58) Field of Classification Search
CPC combination set(s) only.
See application file for complete search history.

(56) References Cited

U.S. PATENT DOCUMENTS

2003/0059231 A1* 3/2003 Watanabe ..... G03G 21/0064 399/129

FOREIGN PATENT DOCUMENTS

JP 2002351197 A 12/2002
JP 2004045570 A 2/2004

* cited by examiner

*Primary Examiner* — Clayton E Laballe
*Assistant Examiner* — Jas Sanghera
(74) *Attorney, Agent, or Firm* — Rossi, Kimms & McDowell LLP

(57) ABSTRACT

An image forming apparatus includes an image bearing member; a developing device; a transfer member; a contact member provided downstream of the transfer member and upstream of the developing device with respect to a movement direction of a surface of the image bearing member and contacting the image bearing member at a contact portion, wherein the surface of the image bearing member passed through a transfer portion reaches the contact portion without being cleaned, a detecting portion for detecting a size of the sheet; and a controller for executing an operation in a cleaning mode for cleaning the contact member. The controller executes the operation in the cleaning mode when the controller discriminates that the size of the sheet detected by the detecting portion is smaller than a size of the toner image.

28 Claims, 7 Drawing Sheets

IMAGE FORMING APPARATUS

FIELD OF THE INVENTION AND RELATED ART

The present invention relates to an image forming apparatus, for forming an image on a sheet using for example an electrophotographic image forming process, such as an electrophotographic copying machine, an electrophotographic printer (for example, laser beam printer, LED printer, etc.) or a facsimile machine.

In recent years, although downsizing of the image forming apparatus advanced, there was a limit on downsizing of the image forming apparatus as a whole when members or devices relating to an image forming process such as processes of charging, exposure, development, transfer, fixing and cleaning were only downsized.

Therefore, also an image forming apparatus of a cleaner-less type in which a cleaning device is removed and a toner remaining on an image bearing member after the transfer process is collected by a developing device and then is used again comes along.

In this image forming apparatus of the cleaner-less type, the toner somewhat remaining on the image bearing member after the toner image is transferred on the sheet is collected by a fog-removing potential difference which is a difference between a DC voltage applied to the developing device and a surface potential. By this constitution, the residual toner is collected by the developing device and then can be used in a subsequent step and later steps. Accordingly, the image forming apparatus can be remarkably downsized by removing the cleaning device from the image forming apparatus.

In such an image forming apparatus of the cleaner-less type, the toner remaining on the image bearing member after the toner image is transferred on the sheet, the toner moved from a transfer member to the image bearing member, and the like toner are deposited on a contact charging member of a contact type. For this reason, a resistance value of the contact charging member fluctuates with an increasing image formation sheet number.

Therefore, a constitution for efficiently removing the toner deposited on the contact charging member has been proposed conventionally.

In Japanese Laid-Open Patent Application (JP-A) 2004-45570, a constitution in which when a charging bias is applied for cleaning the contact charging member, this charging bias is determined depending on the image formation sheet number or an image ratio and thus deterioration of the contact charging member is delayed is disclosed. Thus, there is a bias condition and a hardware condition such that the toner deposited on the contact charging member is easily moved onto the image bearing member, and by effecting control depending on the condition, a lifetime of the contact charging member can be prolonged. Further, such a change in bias condition functions as a further efficient cleaning sequence by being executed depending on a result of detection or the like of a degree of durability deterioration after a threshold of the image formation sheet number, toner consumption or the like is sets.

In normal image formation, a size of the toner image formed by the image forming apparatus is smaller than a size of the sheet which is a recording material (medium) fed to a transfer portion. However, in some instances, a sheet having a size smaller than the size of the toner image formed by the image forming apparatus is fed to the transfer portion, and in this case, a part of the toner image cannot be transferred onto the sheet and remains on the image bearing member for bearing the toner image in some instances.

For example, when the image is formed on the sheet, in addition to a normal sequence in which a user designates a sheet size, there is a universal sequence in which the user does not designate the sheet size. In the normal sequence, in the case where the sheet size designated by the user is different from a size of a sheet which was passed through the transfer portion in actuality, an error is notified to the user and then a job is stopped. On the other hand, in the universal sequence, the image formation is continued without stopping the job irrespective of the size of the sheet passed through the transfer portion is actuality.

In such a universal sequence, in the case where the image formation is effected using the sheet having a width (size) smaller than a width (size) of the toner image, the toner existing at a portion corresponding to a non-sheet-passing region of the image bearing member (for example, a photosensitive drum) is not transferred onto the sheet. In the image forming apparatus of the cleaner-less type, the toner which was not transferred on the sheet is transferred onto not only the transfer member but also the contact charging member or the like in a large amount, so that these members are remarkably contaminated with the toner. Such contamination of the contact charging member and the like with the toner can generate also in the image forming apparatus including the cleaning device, but is particularly conspicuous in the image forming apparatus of the cleaner-less type.

In the case where such contamination generated, when cleaning of the transfer member and the contact cleaning member is made in an ordinary manner, a degree of the cleaning becomes insufficient, so that there is a liability that a back surface of a subsequent sheet is contaminated by the transfer member contaminated with the toner deposited on the transfer member. Further, charging power of the contact charging member lowers, and therefore a photosensitive drum surface cannot be maintained at a predetermined potential, so that there is a liability that image defect is caused.

SUMMARY OF THE INVENTION

A principal object of the present invention is to provide an image forming apparatus capable of preventing image defect by removing a contamination of a contact member, such as a charging roller, provided in contact with an image bearing member even in the case where a sheet having a size smaller than a size of a toner image.

According to an aspect of the present invention, there is provided an image forming apparatus comprising: an image bearing member; a developing device for forming a toner image on the image bearing member by depositing toner on an electrostatic latent image formed on the image bearing member; a transfer member for transferring the toner image onto a sheet at a transfer portion; a contact member provided downstream of the transfer member and upstream of the developing device with respect to a movement direction of a surface of the image bearing member and contacting the image bearing member at a contact portion, wherein the surface of the image bearing member passed through the transfer portion reaches the contact portion without being cleaned, a detecting portion for detecting a size of the sheet; and a controller for executing an operation in a cleaning mode for cleaning the contact member, wherein the controller executes the operation in the cleaning mode when the controller discriminates that the size of the sheet detected by the detecting portion is smaller than a size of the toner image.

Further features of the present invention will become apparent from the following description of exemplary embodiments with reference to the attached drawings.

DESCRIPTION OF THE EMBODIMENTS (First Embodiment)

<Image Forming Apparatus>

A general structure of an image forming apparatus A according to the present invention will be described together with an operation of the image forming apparatus A during image formation with reference to the drawings.

Figure 1:
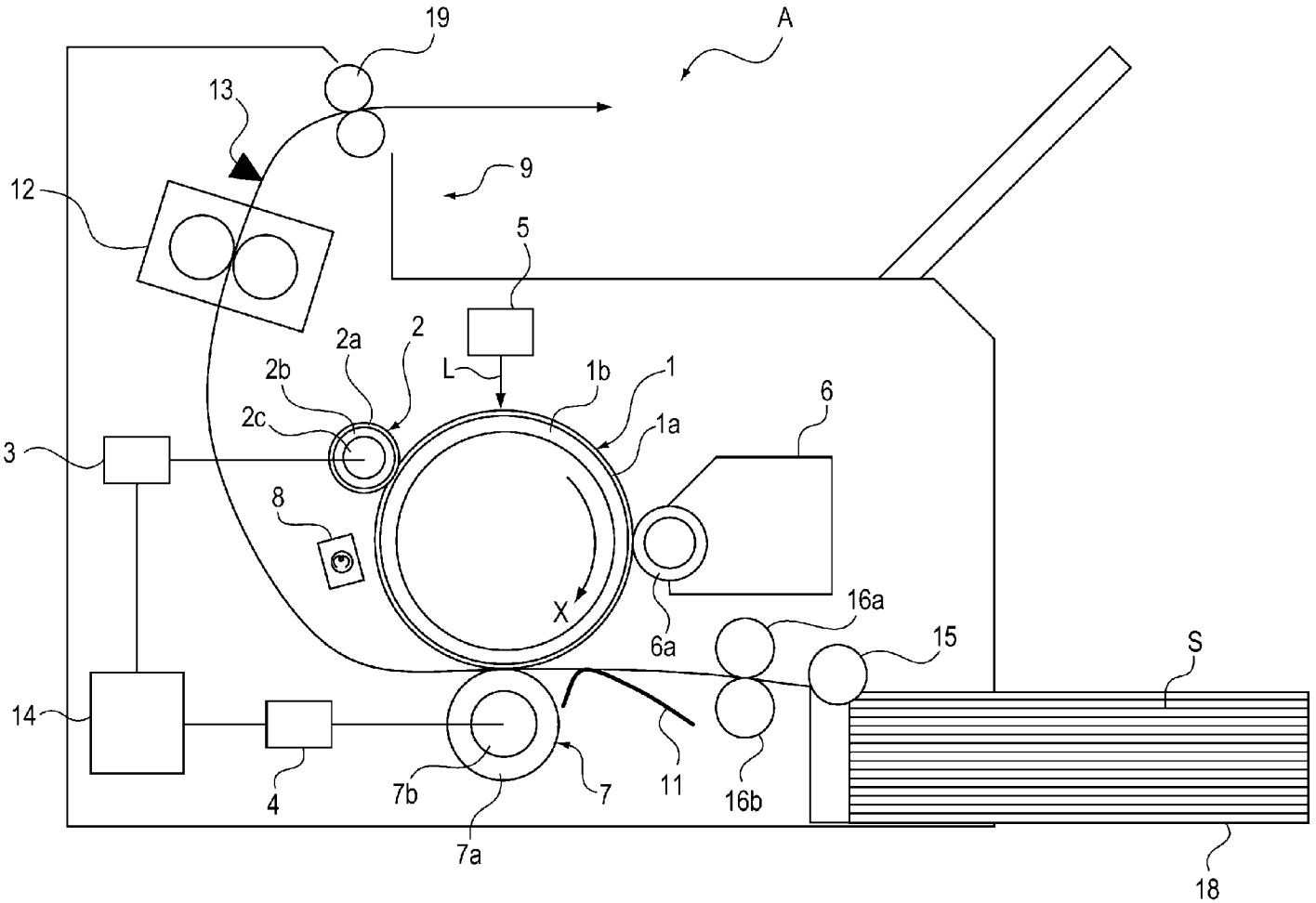
FIG. 1 is a schematic sectional view of an image forming apparatus.

As shown in FIG. 1, the image forming apparatus A includes an image forming portion for transferring a toner image onto a sheet, a sheet feeding portion for feeding the sheet to an image forming portion, and a fixing portion for fixing the toner image on the sheet. In this embodiment, as the sheet, plain paper was used.

The image forming portion includes a photosensitive drum 1 (image bearing member), a charging roller 2 (charging member), a laser scanner unit 5, a developing device 6, a transfer roller 7 (transfer member), and the like.

A controller (control portion) 14 is a control means for controlling an operation of the image forming portion, and respective portions of the image forming portion are operated on the basis of instructions of the controller 14.

The photosensitive drum 1 includes fundamental structural layers consisting of an electroconductive base layer 1*b* formed of aluminum, iron or the like and a photoconductive layer 1*a* which is provided on an outer peripheral surface of the base layer 1*b* and which is formed with an organic photoconductor, for example, and is rotationally driven in the clockwise direction of an arrow X at a predetermined rotational speed. The electroconductive base layer 1*b* is grounded.

The charging roller 2 is of a contact type in which the charging roller 2 is provided in contact with the photosensitive drum 1. This charging roller 2 is constituted by an electroconductive roller 2*c* such as a metal roller which is a core metal, an electroconductive layer 2*b* formed on an outer peripheral surface of the electroconductive roller 2*c*, and a resistance layer 2*a* formed on an outer peripheral surface of the electroconductive layer 2*b*. Further, the electroconductive roller 2*c* is rotatably supported at end portions thereof by unshown bearing members, and is press-contacted to the photosensitive drum 1 with a predetermined pressure (urging force) by an unshown pressing (urging) member such as a spring. The electroconductive roller 2*c* is forcedly driven by an unshown driving means. This charging roller 2 is disposed downstream of the transfer roller 7 and upstream of the developing device 6 with respect to a movement direction of the surface of the photosensitive drum 1, and is a contact member contacting the surface of the photosensitive drum 1. Further, a portion of contact between the photosensitive drum 1 and the charging roller 2 is referred to as a charging portion (contact portion).

The transfer roller 7 is of a contact type in which the charging roller 2 is provided in contact with the photosensitive drum 1, and is constituted by an electroconductive roller 7*b* such as a metal roller as a core metal, and a cylindrical electroconductive layer 7*a* formed on an outer peripheral surface of the electroconductive roller 7*b*. Further, a portion of contact between the photosensitive drum 1 and the transfer roller 7 is referred to as a transfer portion. Further, the electroconductive roller 7*b* is rotatably supported at end portions thereof by unshown bearing members, and is press-contacted to the photosensitive drum 1 by an unshown pressing (urging) member such as a spring. The transfer roller 7 is driven by rotation of the photosensitive drum 1. Incidentally, the transfer roller 7 may also have a constitution in which a gear or the like is mounted to the transfer roller 7 and the transfer roller 7 is forcedly driven by a driving means such as a motor.

The developing device 6 is operated by an unshown moving mechanism so that a developing sleeve 6*a* is contacted to the photosensitive drum 1 during pre-rotation immediately before an image forming process and is spaced from the photosensitive drum 1 at the time of an end of a cleaning sequence described later.

For image formation, when a user sends an image forming job and then the controller 14 such as an image forming signal, a sheet stacked and accommodated in a sheet staking portion 18 is sent to the image forming portion by a feeding roller 15 and conveying rollers 16*a* and 16*b*.

On the other hand, at the image forming portion, as a charging bias, a predetermined DC bias or an oscillating bias in the form of a DC bias superposed with an AC bias is applied from a charging voltage (bias) source 3 to the charging roller 2 though an electrical contact. As a result, the surface of the photosensitive drum 1 contacting the charging roller 2 is electrically charged uniformly to a predetermined polarity and a predetermined potential. In this embodiment, the charging voltage source 3 applies a negative (−polarity) bias as the charging bias during the image formation.

Thereafter, the laser scanner unit 5 emits laser light L from a light source (not shown) provided therein, on the basis of image information, so that the photosensitive drum surface is irradiated with the laser light L. That is, the light source of the laser scanner unit 5 is turned on and off on the basis of the image information. As a result, the potential of the photosensitive drum 1 is partly lowered, so that an electrostatic latent image depending on the image information (image data) is formed on the surface of the photosensitive drum 1. This image information is data contained in the image forming job sent by the user from an unshown host computer or the like to the image forming apparatus A.

Thereafter, a developing bias is applied to the developing sleeve 6*a* provided in the developing device 6, whereby a toner carried on the developing sleeve 6*a* in a thin layer shape is deposited on the electrostatic latent image formed on the surface of the photosensitive drum 1 and thus a toner image is formed. The toner image formed on the surface of the photosensitive drum 1 is sent to a transfer nip formed between the photosensitive drum 1 and the transfer roller 7.

When a leading end of the sheet passes through a pre-transfer guide 11 and then enters the transfer nip, a transfer bias of an opposite polarity to a charge polarity of the toner is applied from a transfer voltage source 4 to the electroconductive roller 7*b*, so that the toner image is transferred onto the sheet. In this embodiment, the toner having the negative polarity as a normal charge polarity is used, and therefore the transfer voltage source 4 applies the transfer bias of the positive polarity is applied as a transfer bias during the image formation.

Thereafter, the sheet on which the toner image is transferred is sent to a fixing device 12 and is heated and pressed at a fixing nip formed between a heating portion and a pressing portion of the fixing device 12, so that the toner image is fixed as a permanently fixed image on the sheet. Then, a sheet width of the sheet is detected by a sheet width sensor 13 (detecting portion), and thereafter, the sheet is discharged to a discharge portion 9 by a discharging roller pair 19. The sheet width sensor 13 detects a width of the fed sheet with respect to an axial direction (perpendicular to a sheet feeding direction) of the photosensitive drum 1. The detection of the sheet width by the sheet width sensor 13 may be accurate width detection of the sheet to be subjected to the detection and may also be detection of whether the sheet width is larger or smaller than one or a plurality of predetermined widths.

On the other hand, after the sheet passes through the transfer nip, at the image forming portion, a DC bias is applied to the developing sleeve 6*a*, so that a toner remaining on the photosensitive drum 1 is collected in the developing device by a potential difference between the DC bias and the surface potential of the photosensitive drum 1.

Further, immediately after the toner image is transferred onto the sheet, a pre-exposure device 8 performs a pre-exposure process in which the surface of the photosensitive drum 1 between the transfer portion and the charging portion is executed to light. As a result, the surface potential of the photosensitive drum 1 is uniformly lowered, so that the photosensitive drum surface is electrically charged efficiently when the photosensitive drum surface reaches the charging roller 2 again.

<Cleaning Sequence>

Next, a first cleaning sequence and a second cleaning sequence which are performed for removing the toner detected on a process member, particularly the charging roller 2 and the transfer roller 7 in this embodiment, provided in contact with the photosensitive drum 1 will be described.

Figure 2:
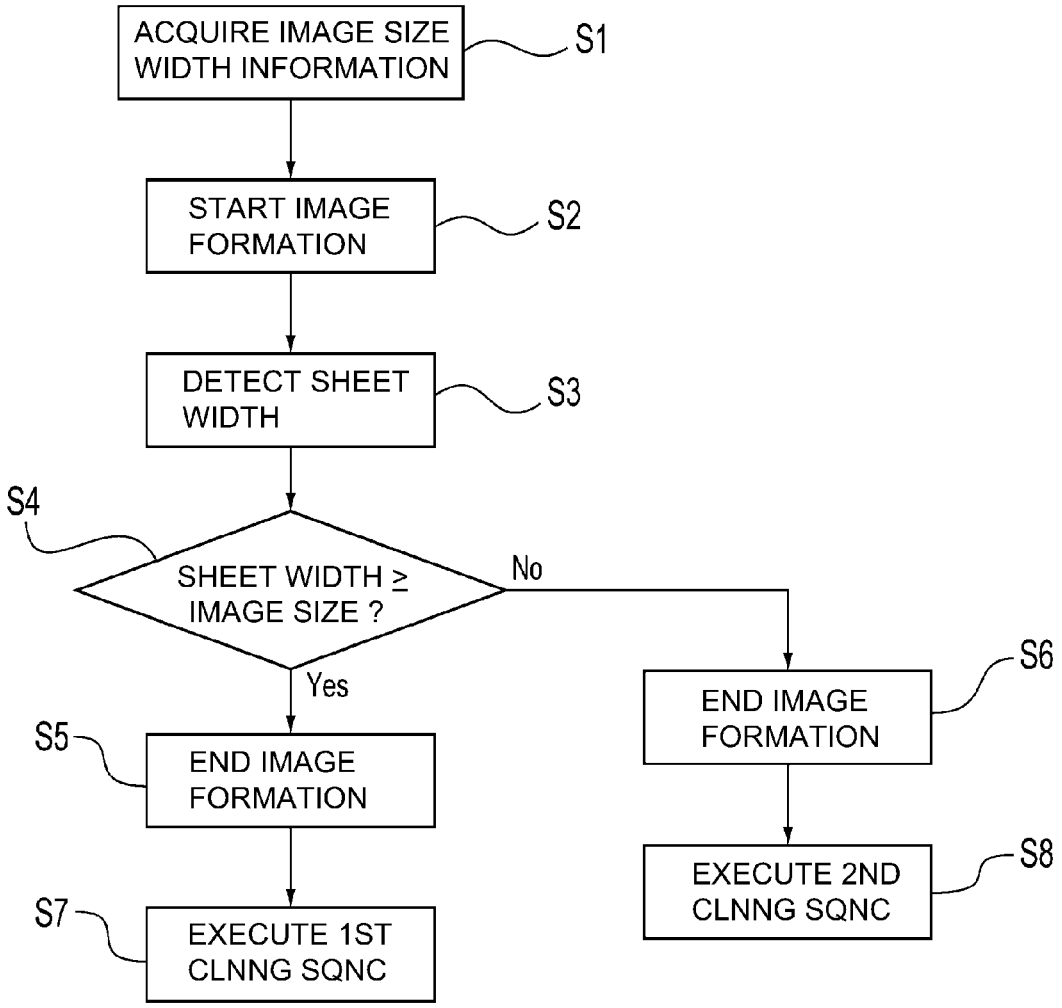
FIG. 2 is a flowchart showing a cleaning sequence.

First, timing and the like when the first sequence and the second sequence are performed will be described using a flowchart shown in FIG. 2. As shown in FIG. 2, first, the image forming job sent by the user is received by the controller 14, so that the controller 14 acquires (detects) information of an image size width with respect to the axial direction of the photosensitive drum 1 (S1). In this embodiment, this image size width is used as information on a width of the toner image.

Then, the image forming apparatus A starts the image forming process (image formation) (S2), and the sheet passes through the sheet width sensor 13 after the image is fixed, so that the sheet width is detected and a detection result thereof is sent to the controller (S3). Incidentally, in this embodiment, the sheet width sensor 13 can detect sheets (of 16k, A4, letter size and the like in size) having a width of not less than 16k (195 mm) and sheets (of A5, A6, envelope and the like in size) having a width of less than 16k. Specifically, as an example in which the sheet width sensor 13 operates, it is possible to cite the case where the sheet width sensor 13 detects the sheet of less than 16k in width although the image size width corresponding to the width of the letter size or the A4 size is acquired by the controller 14 or the like case.

Then, the controller 14 compares the detected image size width and the detected sheet width with each other, and on the basis of a result of comparison thereof, selects whether the first cleaning sequence or the second cleaning sequence which are described later should be executed. Specifically, the controller 14 discriminates whether or not the sheet width is not less than the first size width (S4).

In the case where the sheet width is not less than the image size width, almost of the toner image developed from the electrostatic latent image on the photosensitive drum 1 is transferred onto the photosensitive drum 1, and therefore an amount of the toner deposited on the photosensitive drum 1 after the transfer is slight. Accordingly, even in the image forming apparatus A of the cleaner-less type as in this embodiment, the amount of the toner deposited on the charging roller 2 and the transfer roller 7 after the deposition of the toner on the photosensitive drum 1 is slight.

On the other hand, in the case where the sheet width is less than the image size width, the toner image developed from the electrostatic latent image on the photosensitive drum 1 in a non-sheet-passing region is not transferred onto the sheet but is directly transferred onto the transfer roller 7, so that the transfer roller 7 is conspicuously contaminated with the toner.

Further, to the transfer roller 7, the bias of the photosensitive drum is continuously applied during the sheet passing through the transfer portion, and therefore, electric discharge of the bias of the positive polarity generates to a non-sheet-passing portion of the transfer roller 7. As a result, the negatively charged toner is reversed in polarity by receiving the bias of the positive polarity, so that a reversely charged toner charged to the positive polarity is moved onto the photosensitive drum 1.

The reversely charged toner deposited on the photosensitive drum 1 after the toner and the reversely charged toner moved from the transfer roller 7 onto the photosensitive drum 1 are charged again to the negative polarity by the charging roller 2 in a normal operation, and then are collected by the developing device 6. However, in the case where an amount of the deposited reversely charged toner is large, all of the reversely charged toner cannot be completely charged to the negative polarity by the charging roller 2 in some instances. Further, a part of the reversely charged toner of which charge is not returned to the negative polarity is deposited on the charging roller 2, so that a degree of contamination of the charging roller 2 with the reversely charged toner progresses depending of a frequency of use.

In the case where the contamination of the charging roller 2 progresses, cleaning power lowers, so that the charge potential of the photosensitive drum 1 at a portion corresponding to a contaminated portion of the charging roller 2 lowers during subsequent image formation. For this reason, the electrostatic latent image is positioned with the toner in the non-sheet-passing region or an unintended region of the photosensitive drum 1, so that contamination at respective members is promoted and image defect is caused. For this reason, there is a need to effect cleaning of the charging roller 2 periodically.

Therefore, after an end of the image forming process of the job (S5, S6), during post-rotation, the controller 14 executes the first cleaning sequence (operation in first cleaning mode) when the controller 14 discriminates that the sheet width is not less than the image size width (i.e., not less than the size of the toner image) (S7). On the other hand, the controller 14 executes the second cleaning sequence (operation in second cleaning mode) which is higher in cleaning power than the first cleaning sequence when the controller 14 discriminates that the sheet width is less than the image size width (i.e., less than the size of the toner image) (S8). As a result, the contamination of the transfer roller 7 and the charging roller 2 is sufficiently eliminated, so that it is possible to suppress the image defect due to the contamination of these members. Incidentally, the higher cleaning power means that the toner deposited on the member to be cleaned is removed in a larger amount.

Next, specific contents of the first cleaning sequence and the second cleaning sequence in this embodiment will be described. These cleaning sequences are executed on the basis of instructions of the controller 14.

In the first cleaning sequence, in this embodiment, the transfer roller 7 is cleaned every post-rotation after the end of the image forming process, and the transfer roller 7 and the charging roller 2 are cleaned every passing of 100 sheets.

The cleaning of the transfer roller 7 is made by first applying the bias of the positive polarity from the transfer voltage source 4 to the transfer roller 7 for a time corresponding to one-full-circumference of the transfer roller 7 and then by applying the bias of the negative polarity for the time corresponding to the one-full-circumference of the transfer roller 7. At this time, to the charging roller 2, the bias of the negative polarity has been applied in advance. Then, this operation is repeated once more. Then, the image forming apparatus A is kept on stand-by for a time corresponding to one-full-circumference of the photosensitive drum 1.

The toner is gradually deposited on the transfer roller 7 depending on a frequency of use, but on the photosensitive drum 1, not only the toner charged to the negative polarity which is the normal charge polarity of the toner but also the reversely charged toner charged to the opposite polarity can exist. For this reason, the polarity of the toner deposited on the transfer roller 7 is not uniform, and in some cases, the toner of the positive polarity and the negative polarity are separately deposited on the transfer roller 7. Therefore, as described above, both of the biases of the positive polarity and the negative polarity are alternately applied to the transfer roller 7, so that an electric field for moving the toner from the transfer roller 7 toward the photosensitive drum 1 is formed even when the toner deposited on the transfer roller 7 has either of the positive polarity and the negative polarity. As a result, not only the toner charged to the normal charge polarity but also the reversely charged toner can be moved from the transfer roller 7 to the photosensitive drum 1, so that the transfer roller 7 can be cleaned with higher reliability.

Further, the image forming apparatus A in this embodiment is of the cleaner-less type as described above, and therefore, the image forming apparatus A does not include a cleaner (cleaning member) exclusively for removal of the toner moved from the transfer roller 7 to the photosensitive drum 1. The cleaner exclusively for the toner removal is a member, such as an elastic blade, which contacts the surface of the photosensitive drum 1 after passing through the transfer portion and before reaching the charging portion and which is capable of scraping the toner and the like of the surface of the photosensitive drum 1. With respect to a rotational axis direction, in general, a width of the photosensitive drum 1 in a contact region where the exclusive cleaner contacts the surface of the photosensitive drum 1 is larger than a developing width which is a width of a region where the toner can be deposited on the photosensitive drum 1 by the developing device 6. Further, as a positional relationship with respect to the rotational axis direction, the cleaner, the photosensitive drum 1 and the developing device 6 are disposed so that an entire region with the developing width is included in the contact region, and therefore, the toner deposited on the surface of the photosensitive drum 1 passed through the transfer portion can be mostly scraped off when the exclusive cleaner is used.

That is, when the image forming apparatus A does not include the exclusive cleaner, the surface of the photosensitive drum 1 passed through the transfer portion reaches the charging portion without contacting the exclusive cleaner or the like. Accordingly, the toner moved from the transfer roller 7 reaches a position of the charging roller 2 by rotation of the photosensitive drum 1.

The toner moved from the transfer roller 7 when the transfer voltage source 4 applied the bias of the positive polarity is the reversely charged toner charged to the positive polarity, and therefore, is not collected in the developing device 6 in a state in which the reversely charged toner is left as it is. Therefore, the bias of the negative polarity is applied to the charging roller 2 to cause electric discharge, so that the toner is charged again to the negative polarity. As a result, the toner can be collected by the developing device 6.

On the other hand, the toner moved from the transfer roller 7 when the bias of the negative polarity is applied has the negative polarity which is the same as the charging bias. Accordingly, the toner is collected by the developing device as it is without being deposited on the charging roller 2.

Next, cleaning of the charging roller 2 will be described. The cleaning of the charging roller 2 is made by applying the bias of the positive polarity from the charging voltage source 3 to the charging roller 2 for a time corresponding to one-full-circumference of the photosensitive drum 1 and then by applying the bias of the negative polarity for a time corresponding to the one-full-circumference of the photosensitive drum 1.

Thus, by applying the bias of the positive polarity to the charging roller 2, the reversely charged toner deposited on the charging roller 2 can be moved onto the photosensitive drum 1. Incidentally, also by turning off the application of the bias to the charging roller 2, a similar effect is achieved.

The reversely charged toner moved from the charging roller 2 is moved again to the charging roller 2 by rotation of the photosensitive drum 1. Then, at timing when the reversely charged toner moved from the charging roller 2 reaches the charging roller 2 again, by applying the bias of the negative polarity to the charging roller 2, the reversely charged toner on the photosensitive drum 1 can be charged to the negative polarity. The negatively charged toner on the photosensitive drum 1 is collected by the developing device.

Incidentally, a time, a number of times and a frequency of application of the biases to the charging roller 2 and the transfer roller 7 are not limited to those described above, but may only be required to be changed to optimum values depending on a structure of the image forming apparatus A.

Next, the second cleaning sequence will be described.

In the second cleaning sequence, first, the developing sleeve 6*a* of the developing device 6 is spaced from the photosensitive drum 1. As a result, even when a potential of a part of the surface of the photosensitive drum 1 is lowered by insufficient charging generated due to contamination of the charging roller 2, it is possible to prevent the toner carried on the developing sleeve 6*a* from being deposited on the photosensitive drum 1.

Then, the bias of the negative polarity is applied to the transfer roller 7 and the charging roller 2 while rotating the photosensitive drum 1. At this time, a pre-exposure process is performed by a pre-exposure device 8 simultaneously. In this embodiment, this operation is performed for 10 sec.

As a result, first, a part of the reversely charged toner deposited on the charging roller 2 is charged again to the negative polarity and is moved onto the photosensitive drum 1. By performing this operation for 10 sec, the reversely charged toner deposited on the charging roller 2 is successively charged to the negative polarity and is moved onto the photosensitive drum 1. At this time, by performing the pre-exposure process, electric discharge can be generated efficiently and thus re-charging of the toner to the negative polarity is promoted. The toner moved to the photosensitive drum 1 is the toner charged to the negative polarity, and therefore, even when the toner reaches again the charging roller 2, the toner 2, the toner is prevented from being deposited on the charging roller 2 again. Further, the bias of the negative polarity is continuously applied to also the transfer roller 7, and therefore the toner moved from the charging roller 2 is also prevented from being deposited on the transfer roller 7.

Then, the toner carried on the photosensitive drum 1 is collected in the developing device 6 by bringing the developing sleeve 6*a* into contact with the photosensitive drum 1. In this stage, the contamination of the charging roller 2 with the toner is eliminated, and therefore the surface of the photosensitive drum 1 is electrically charged uniformly by the charging roller 2. Accordingly, the toner is not moved from the developing sleeve 6*a* to the photosensitive drum 1.

Then, the bias of the positive polarity is applied to the transfer roller 7. This is because the bias of the negative polarity is continuously applied to also the transfer roller 7, and therefore the reversely charged toner existing on the photosensitive drum 1 is deposited on the transfer roller 7 although an amount thereof is small. For this reason, by applying the bias of the positive polarity to the transfer roller 7, the toner of the positive polarity remaining on the transfer roller 7 can be moved onto the photosensitive drum 1. The moved toner is charged again to the negative polarity by the charging roller 2 and then is contacted in the developing device 6.

As described above, not only the first cleaning sequence but also the second cleaning sequence are executed depending on a situation, so that the contamination of the transfer roller 7 and the charging roller 2 is sufficiently eliminated and thus states of the transfer roller 7 and the charging roller 2 can be normally maintained. Accordingly, image defect due to the contamination of the transfer roller 7 and the charging roller 2 can be prevented.

(Second Embodiment)

Second Embodiment of the image forming apparatus A according to the present invention will be described with reference to the drawings. Redundancy in description between First and Second Embodiments will be omitted using the same drawing(s) and reference numerals or symbols.

In the image forming process, in such a case of a job in which a sheet width is less than an image size width and in which passing of a plurality of sheets is made, the transfer roller 7 and the charging roller 2 are very liable to be contaminated with the toner in some cases. At this time, as in First Embodiment, even when the second cleaning sequence is executed during the post-rotation after the image forming process, the transfer roller 7 and the charging roller 2 cannot be completely restored, so that there is a liability that the image defect is generated.

Therefore, in this embodiment, in the case where the job in which the sheet width is less than the image size width and in which the image is continuously formed on a predetermined number of sheets or more is selected, a third cleaning sequence (operation in third cleaning mode) is forcedly executed every predetermined number of sheets and then the second cleaning sequence is executed during the post-rotation. In the following, the cleaning sequences in this embodiment will be described using a flowchart shown in FIG. 3.

Figure 3:
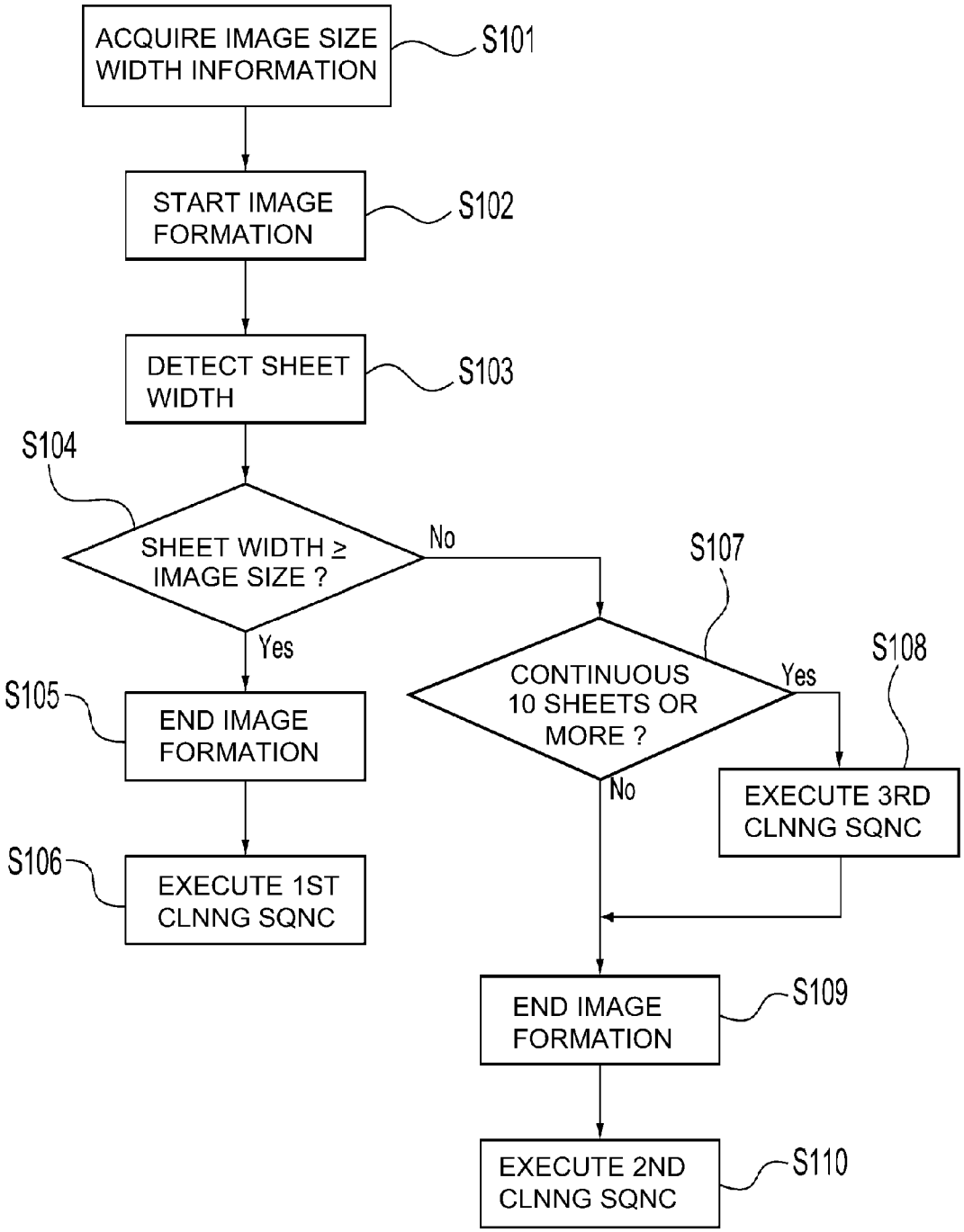
FIG. 3 is a flowchart showing a cleaning sequence.

As shown in FIG. 3, when the controller 14 receives an image forming job sent by the user, similarly as in First Embodiment, first, the controller 14 compares the image size width with the detected sheet width, and then discriminate whether or not the detected sheet width is not less than the image size width (S101-S104).

In the case where the controller 14 discriminated that the sheet width is not less than the image size width, after the image forming process of the job is ended (S105), the controller 14 executes the first cleaning sequence similarly as in First Embodiment (S106).

On the other hand, in the case where the controller 14 discriminated that the sheet width is less than the image size width, the controller 14 discriminates whether or not an image formation sheet number is continuously not less than a predetermined number of sheets (S107). In this embodiment, the predetermined number of sheets was 10 sheets.

In the case where the controller 14 discriminated that the image formation sheet number in the job is less than 10 sheets, after the image forming process of the job is ended (S109), similarly as in First Embodiment, the second cleaning sequence is executed (S110).

On the other hand, in the case where the controller 14 discriminated that the image formation sheet number is not less than 10 sheets, the third cleaning sequence is executed at timing before the image forming process in the job is ended (S108). The third cleaning sequence was executed during a sheet interval operation every 10 sheets subjected to image formation.

The operation of this third cleaning sequence is basically the same as that in the second cleaning sequence. However, the third cleaning sequence is executed before the end of the image forming process, and therefore it is desirable that the third cleaning sequence is ended in a short time. The third cleaning sequence is executed every predetermined number of sheets, and therefore, an accumulation amount of the contaminant is estimated as being a small. Therefore, in the third cleaning sequence, different from the second cleaning sequence, the time of application of the bias of the negative polarity to the transfer roller 7 and the charging roller 2 while rotating the photosensitive drum 7 was not 10 sec, but was 5 sec. Other operations are similar to those in First Embodiment.

The third cleaning sequence is ended, and after the image forming process is ended (S109), the second cleaning sequence is executed during the post-rotation (S110).

Thus, the third cleaning sequence is executed before the execution of the second cleaning sequence, so that even in the case where the transfer roller 7 and the charging roller 2 are remarkably contaminated with the toner by the continuous sheet passing, the contamination can be eliminated with reliability and thus the image defect can be prevented. Further, the third cleaning sequence is executed during the sheet interval operation every predetermined number of sheets, so that the cleaning can be made periodically depending on the contamination amount.

In order to check an effect of the cleaning sequence in this embodiment, an image forming apparatus in which the third cleaning sequence is executed for each of 5 sheets, 10 sheets and 15 sheets as a continuous sheet passing number and an image forming apparatus in which the third cleaning sequence is not executed were prepared.

As a checking method of the effect, first, a job for continuously forming solid black images having an A4 width on each of 10 sheets, 15 sheets, 20 sheets and 30 sheets is sent, and sheets of less than the A4 width in size are passed. After an end of the post-rotation, one sheet of the A4 width in size on which a solid white image was formed was passed, and then whether or not the image defect generated under each of the conditions was checked.

As an experimental condition, in an environment of 23° C. in ambient temperature and 50% in humidity, sheets of 80 g/m$^2$ in basis weight, 148 mm in width and 297 mm in length and A4-sized paper (width: 210 mm, length: 297 mm) having the same basis weight were used. In either of the image forming apparatuses, the second cleaning sequence was executed. An experimental result is as follows.

TABLE 1

| Timing*1 | 10 SH*2 | 15 SH*2 | 20 SH*2 | 25 SH*2 |
|---|---|---|---|---|
| Every 5 SH*2 | A | A | A | A |
| Every 10 SH*2 | A | A | A | A |
| Every 15 SH*2 | A | A | A | A |
| Not executed | A | B | C | C |

*1"Timing" is execution timing of the third cleaning sequence.

*2"SH" is sheets subjected to the sheet passing. "A" represents no generation of the image defect. "B" represents generation of the image defect in a small amount. "C" represents generation of the image defect.

As shown in Table 1, in the case where the sheet passing was made under a condition that the sheet width is narrower than the image size width, in the constitution in which sheet interval cleaning is not made, when 15 sheets or more were subjected to the sheet passing, the image defect generated even when the second cleaning sequence was performed during the post-rotation.

In the constitution in which the third cleaning sequence was executed every 15 sheets, when 15 sheets were subjected to the sheet passing, the contaminant could be completely generated, and the image defect generated although a degree thereof was slight. When 30 sheets were subjected to the sheet passing, an accumulated contaminant caused a clear image defect.

On the other hand, in the constitution in which the third cleaning sequence was executed every 5 sheets and every 10 sheets, even when 30 sheets were subjected to the sheet passing, the image defect did not generate. Thus, it is clear that a cleaning property becomes higher when the third cleaning sequence is performed with a lower frequency. However, when the frequency is increased, there is a liability that deterioration of respective members is hastened. Accordingly, execution of the third cleaning sequence with a frequency such that the cleaning property can be sufficiently confirmed is effective.

In this embodiment, as a proper value, the third cleaning sequence with the frequency of the continuous sheet passing every 10 sheets was executed, but as regards the frequency, there is a proper value for each of the constitutions of the image forming apparatus, and therefore, it is only required that a frequency suitable for the constitution of the image forming apparatus is set.

In this embodiment, the constitution in which the third cleaning sequence was executed when the number of sheets subjected to continuous sheet passing is not less than a predetermined number of sheets, but the present invention is not limited thereto. A constitution in which the third cleaning sequence is executed when the image forming process is performed under a condition that the charging roller 2 and the frequency roller 7 are easily contaminated may also be employed.

(Third Embodiment)

Third Embodiment of the image forming apparatus A according to the present invention will be described with reference to the drawings. Redundancy in description among First to Third Embodiments will be omitted using the same drawing(s) and reference numerals or symbols.

Figure 4:
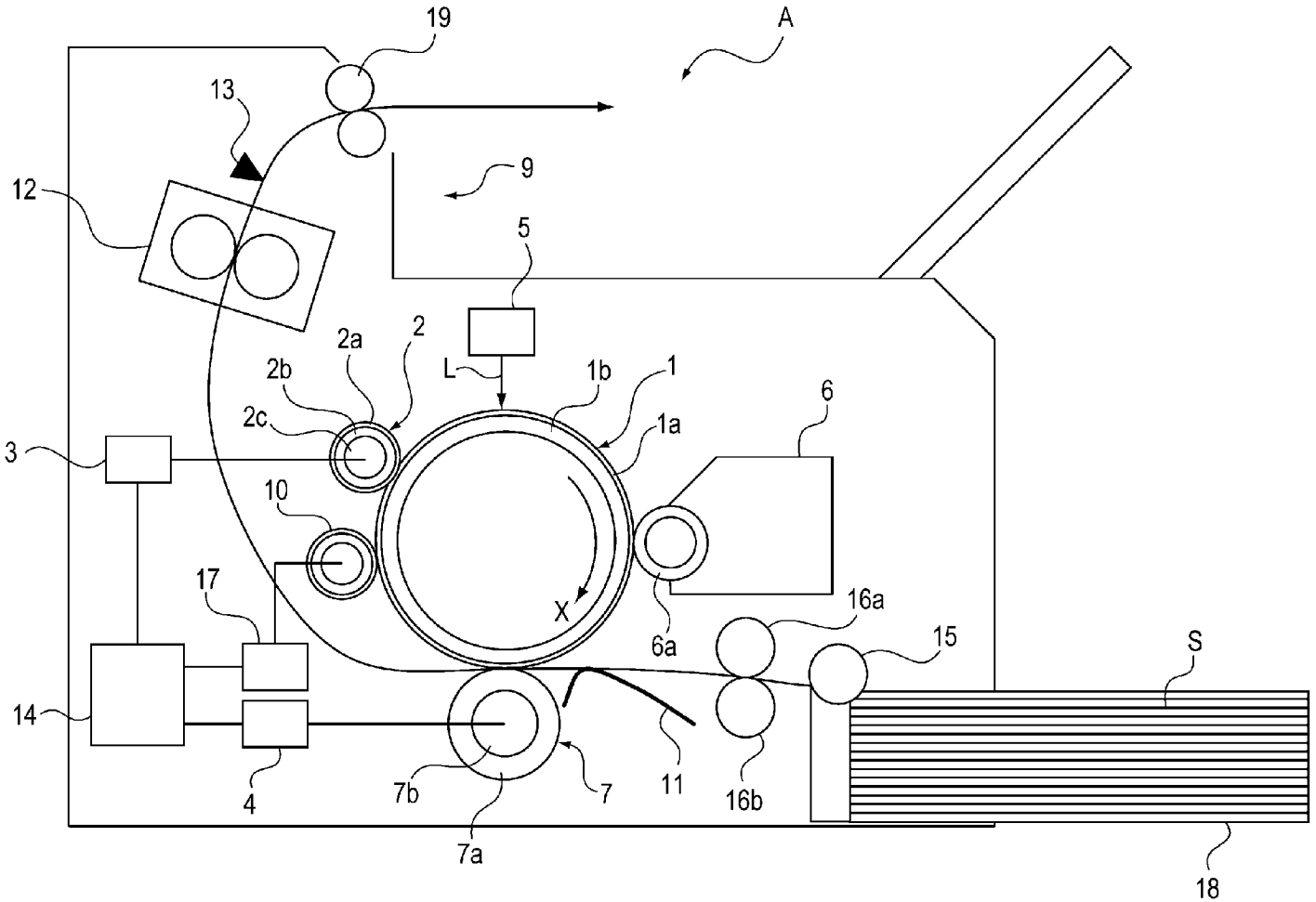
FIG. 4 is a schematic sectional view of an image forming apparatus.

The image forming apparatus A in this embodiment employs, as shown in FIG. 4, a constitution in which in addition to the constitution of Second Embodiment, as the contact member, an auxiliary charging roller 10 (auxiliary charging means) for assisting charging of the photosensitive drum 1 is added and the pre-exposure device 8 is demounted. For this reason, a plurality of charging members for electrically charging the photosensitive drum 1 are provided. In this embodiment, as the auxiliary charging roller 10, an auxiliary charging roller similar to the charging roller 2 was used. That is, the auxiliary charging roller 10 is disposed downstream of the transfer roller 7 and upstream of the developing device 6 with respect to a movement direction of the surface of the photosensitive drum 1, and is the contact member contacting the surface of the photosensitive drum 1.

The auxiliary charging roller 10 is disposed in a side user of the charging roller 2 with respect to the movement direction of the surface of the photosensitive drum 1, and is connected with an auxiliary charging voltage source 17. The auxiliary charging voltage source 17 applies the charging bias to the auxiliary charging roller 10, so that the auxiliary charging roller 10 can electrically charge the surface of the photosensitive drum 1 before the cleaning sequence 2 electrically charges the surface of the photosensitive drum 1 and thus the charging process can be performed uniformly.

By providing the auxiliary charging roller 10, the reversely charged toner can be temporarily held by the auxiliary charging roller 10. Accordingly, it is possible to suppress deposition of the reversely charged toner on the charging roller 2 disposed downstream of the auxiliary charging roller 10 with respect to the movement direction of the surface of the photosensitive drum 1, so that the charging process can be stably performed for a long term. That is, in this embodiment, the charging roller 2 and the auxiliary charging roller 10 are disposed downstream of the transfer roller 7 and upstream of the developing device 6 with respect to the movement direction of the surface of the photosensitive drum 1, and are the contact members contacting the surface of the photosensitive drum 1.

However, depending on a frequency of use, a contaminant by the toner is accumulated on also the auxiliary charging roller 10. Particularly, in the case where the sheet width is less than the image size width, there is a liability that the toner in a large amount which is subjected to development of the electrostatic latent image at the non-sheet-passing portion exceeds toner retaining power by the auxiliary charging roller 10 and reaches the charging roller 2. In this case, the photosensitive drum 1 cannot be electrically charged uniformly, so that the image defect can be caused.

Therefore, also the auxiliary charging roller 10 is cleaned. Specifically, when the sheet width is not less than the image size width, during execution of the above-described first cleaning sequence, cleaning similar to that of the charging roller 2 is made for also the auxiliary charging roller 10. Further, when the sheet width is less than the image size width, during the execution of the second cleaning sequence, cleaning similar to that of the charging roller 2 is made for also the auxiliary charging roller 10. Further, in the case where a job in which the sheet width is less than the image size width and images are continuously formed on not less than a predetermined number of sheets is selected, during execution of the third cleaning sequence, cleaning similar to that of the charging roller 2 is made for also the auxiliary charging roller 10. The image forming apparatus A in this embodiment does not include the pre-exposure device, and therefore, the pre-exposure is not made in the second cleaning sequence and the third cleaning sequence.

As a result, the toners deposited on not only the transfer roller 7 and the charging roller 2 but also the auxiliary charging roller can be removed and thus the rollers can be cleaned, so that an effect of suppressing the image defect is enhanced.

In this embodiment, as the auxiliary charging roller 10, an auxiliary charging roller similar to the charging roller 2 was used. However, the auxiliary charging roller 10 is not limited thereto, but an auxiliary charging roller having a constitution specialized for a function to which priority is to be given may also be used. For example, when importance is placed on suppression of the deposition of the toner on the charging roller 2, it would be considered that a constitution in which a surface layer of the auxiliary charging roller is roughened more than the charging roller 2 or a constitution in which a foamed roller is used to enhance toner retaining power on the photosensitive drum 1 is employed.

Further, the auxiliary charging roller 10 may also be used as a cleaning roller 10 of which function is charged from auxiliary charging to removal of the contaminant such as paper powder deposited on the photosensitive drum 1. In this case, the cleaning roller 10 is disposed downstream of the transfer roller 7 and upstream of the developing device 6 with respect to the movement direction of the surface of the photosensitive drum 1, and corresponds to the contact member contacting the surface of the photosensitive drum 1.

In the above-described First to Third Embodiments, although the sheet width was detected by attaching the sheet width sensor 13 to the sheet feeding path positioned behind the fixing device 12, the present invention is not limited thereto. For example, a constitution in which the sheet width is detected by attaching a sensor to the sheet stacking portion 18 or a sheet size setting guide on an unshown manual feeding tray and then by detecting whether or not the sheet contacts the sensor at both ends thereof or a constitution in which a sensor such as an optical sensor is provided in the sheet feeding path and then sheet passing is detected may also be employed.

In this embodiment, the controller 14 detected the toner image width by calculating the toner image width on the basis of image size information sent by the user. However, the present invention is not limited thereto, but for example, a maximum width of exposure, with respect to the axial direction of the photosensitive drum 1, of the photosensitive drum 1 to light in actuality may also be detected as information on the toner image width by monitoring exposure timing of the laser scanner unit 5.

In the present invention, the cleaning mode is not limited to those described above. That is, the second cleaning sequence may only be required to have cleaning power higher than that of the first cleaning sequence. For example, a constitution in which as the second cleaning sequence, control similar to the first cleaning sequence is executed for a longer time or a constitution in which the second cleaning sequence is performed plural times may also be employed, and other means suitable for the constitution of the image forming apparatus A may only be required to be appropriately selected.

(Fourth Embodiment)

In the above-described embodiments, the controller 14 performed the above-described cleaning sequences after the sheet width and the toner image width were compared with respect to the lengths with respect to the axial direction of the photosensitive drum 1, but the present invention is not limited thereto. That is, in this embodiment, the controller 14 compares the sheet width (sheet length) with the toner image width (toner image length) with respect to lengths along a direction (sheet feeding direction) perpendicular to the axial direction of the photosensitive drum 1. Then, the controller 14 may also perform the cleaning sequences similarly as in the above-described embodiments depending on each of the case where the controller 14 discriminates that the sheet width is not less than the toner image width and the case where the controller 14 discriminated that the sheet width is less than the toner image width. In this case, the sheet width sensor 13 detects the sheet width with respect to the sheet feeding direction, and the controller 14 detects information on the toner image width with respect to the sheet feeding direction (perpendicular to the axial direction of the photosensitive drum 1. In the following, Fourth Embodiment will be described. Redundancy in description among First to Fourth Embodiments will be omitted using the same drawing(s) and reference numerals or symbols.

Figure 7:
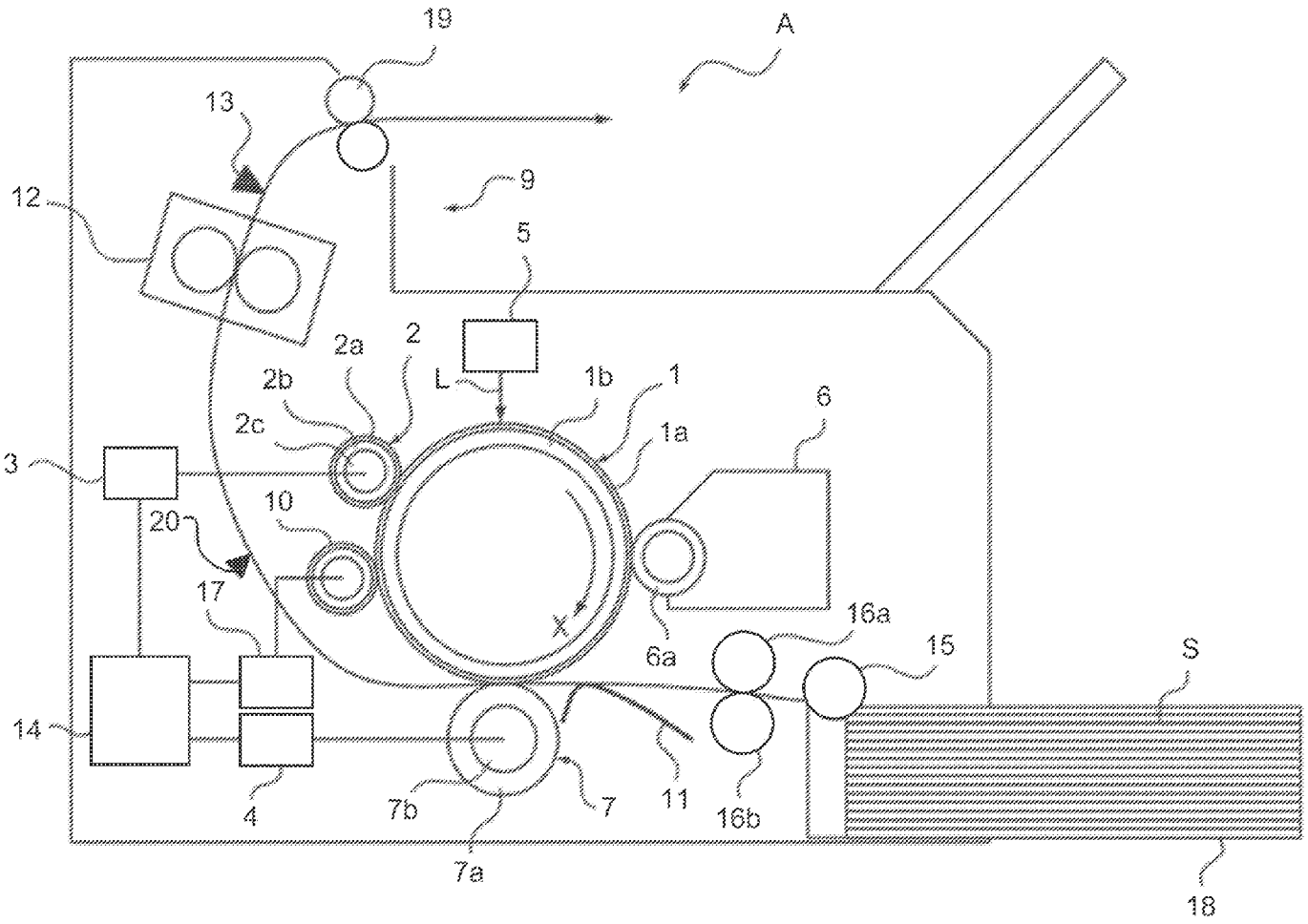
FIG. 7 is a schematic sectional view of an image forming apparatus.

FIG. 7 is a sectional view of an image forming apparatus A in this embodiment. A difference of this embodiment from the above-described embodiments is that a sheet length sensor 20 for detecting a sheet length is provided. The controller 14 can detect information on the toner image width (sheet length) with respect to the sheet feeding direction 8 perpendicular to the axial direction of the photosensitive drum 1) by using the sheet length sensor 20.

Figure 5:
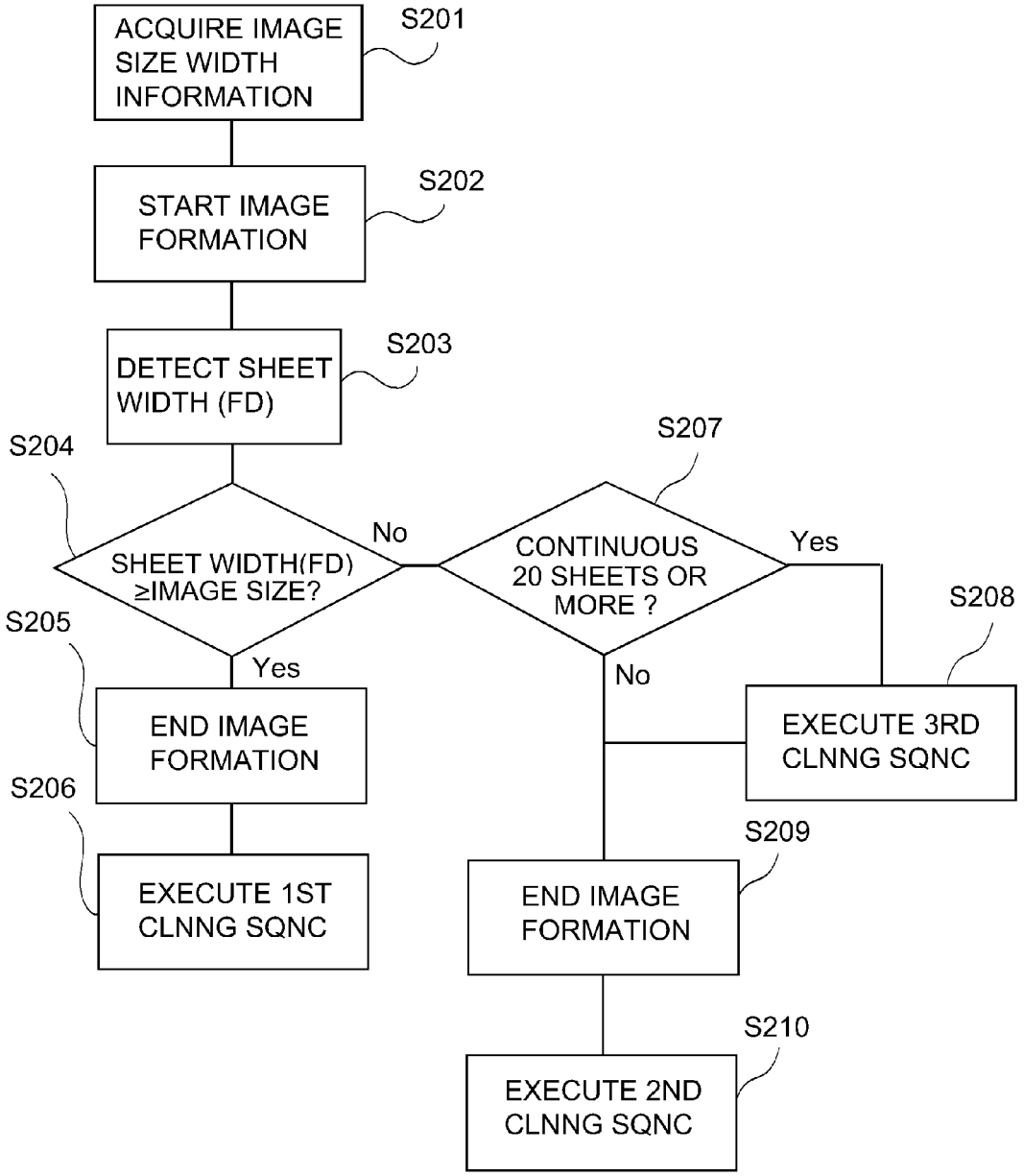
FIG. 5 is a flowchart showing a cleaning sequence.

As shown in FIG. 5, when the controller 14 receives an image forming job sent by the user, first, the controller 14 compares the image size width with the detected sheet width with respect to the sheet feeding direction and discriminates whether or not the detected sheet width is not less than the image size width (S201-S204).

In the case where the controller 14 discriminated that the sheet width was not less than the image size width with respect to the sheet feeding direction, then the controller 14 executes, after the image forming process of the job is ended (S205), the first cleaning sequence similar to that in First Embodiment (S206). On the other hand, in the case where the controller 14 discriminated that the sheet width was less than the image size width with respect to the sheet feeding direction, then the controller 14 discriminates whether or not the image formation sheet number is continuously not less than a predetermined number of sheets (S207). In this embodiment, the predetermined number of sheets was 20 sheets. In the case where the controller discriminated that the sheet width was continuously less than 20 sheets, after the image forming process of the job is ended (S209), the controller 14 executes the second cleaning sequence similarly as in First Embodiment (S210).

On the other hand, in the case where the controller 14 discriminated that the image formation sheet number of the job is continuously not less than 20 sheets, the controller 14 executes the third cleaning sequence at timing before the image forming process of the job is ended (S208). In this embodiment, the third cleaning sequence was executed during a sheet interval operation performed every image formation on 20 sheets.

Incidentally, in this embodiment, as a proper value, the third cleaning sequence was executed with a frequency continuous sheet passing of 20 sheets, but as regards the frequency, the proper value thereof exists depending on the structure of the image forming apparatus, and therefore, the frequency suitable for the structure of the image forming apparatus may only be required to be set.

Further, in this embodiment, a constitution in which the third cleaning sequence is executed when the number of sheets subjected to the continuous sheet passing is not less than the predetermined number of sheets was employed, but similarly as in Second Embodiment, the present invention is not limited thereto. The present invention may also employ a constitution in which the third cleaning sequence is executed when the image forming process is performed under a condition that the charging roller 2 and the transfer roller 7 are liable to be contaminated with the toner.

(Fifth Embodiment)

Fifth Embodiment of the image forming apparatus A according to the present invention will be described with reference to the drawings. Redundancy in description among First to Fifth Embodiments will be omitted using the same drawing(s) and reference numerals or symbols.

This embodiment corresponds to a combination of the case where the toner image width is larger than the sheet width with respect to the sheet feeding direction with the case where the toner image width is longer than the sheet width with respect to the axial direction (perpendicular to the sheet feeding direction) of the photosensitive drum 1. In this embodiment, both of the second cleaning sequence and the third cleaning sequence are executed irrespective of the width and the length of the sheet. A flow chart of this embodiment is FIG. 6.

Figure 6:
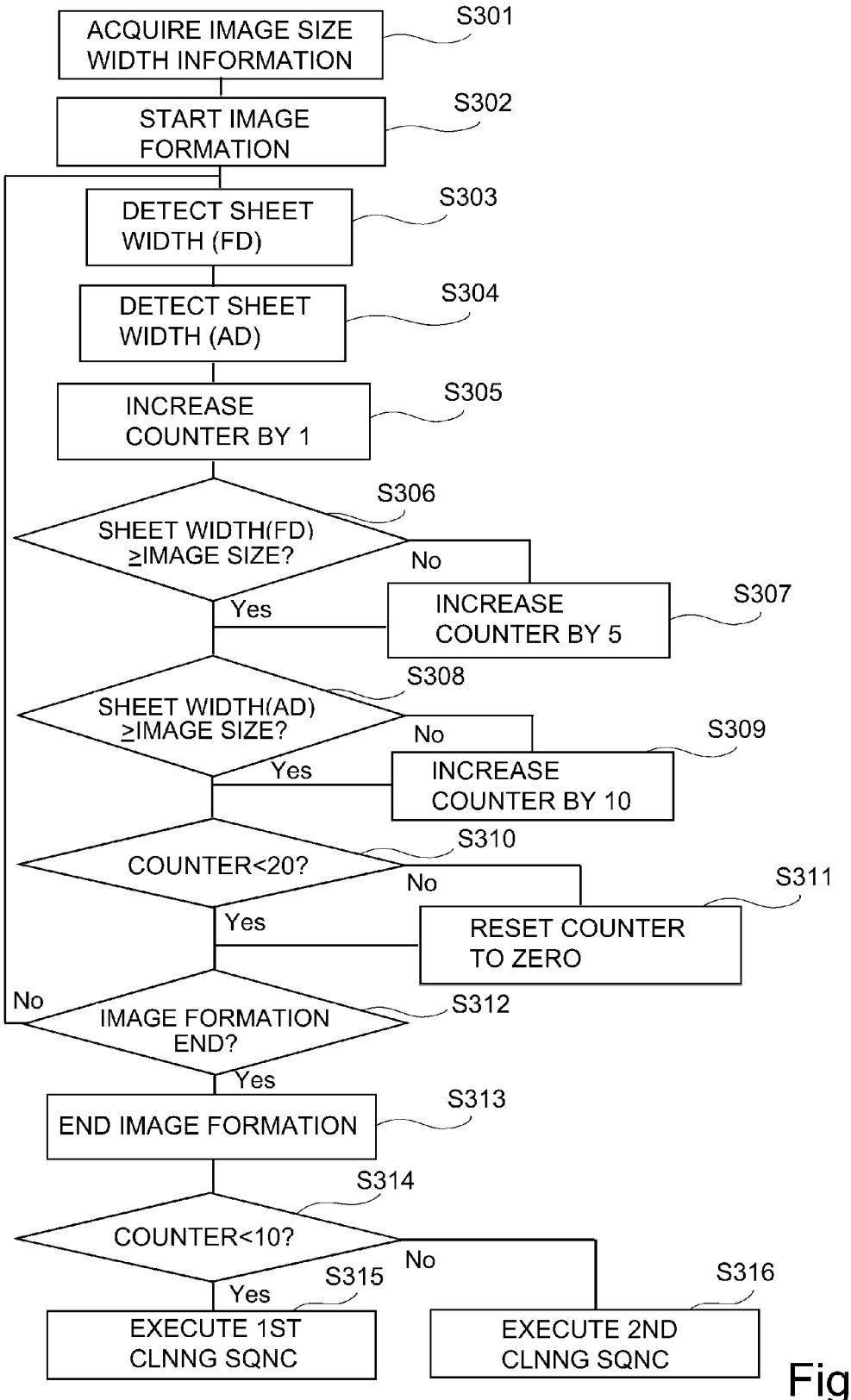
FIG. 6 is a flowchart showing a cleaning sequence.

As shown in FIG. 6, when the controller 14 receives the image forming job sent by the user, first, the controller 14 detects the image size width, the detected sheet width, the image size length and the detected sheet length (S301-S304).

Then, a cleaning sequence counter is increased in count by 1 (S305). The cleaning sequence counter is a counter indicating a degree of contamination of the charging roller 2. When the sheet width is less than the image size width with respect to the sheet feeding direction, the charging roller 2 is contaminated with the toner which was not transferred onto the sheet, and therefore the cleaning sequence counter is increased in count by 5 (S306, S307). When the sheet width is less than the image size width with respect to the axial direction of the photosensitive drum 1, the charging roller 2 is contaminated with the toner which was not transferred onto the sheet, and therefore the cleaning sequence counter is increased in count by 10 (S308, S309).

Then, when the cleaning sequence counter indicated 20 or more, it is considered that the contamination of the charging roller 2 advances, and the third cleaning sequence is executed, so that the charging roller 2 is cleaned by the third cleaning sequence and therefore the cleaning sequence counter is rest to zero (S310, S311). This operation is repeated with the image formation is ended (S312, S313).

Finally, when the cleaning sequence counter indicates 10 or more, it is considered that the contamination of the charging roller 2 advances, and the second cleaning sequence is executed (S314, S315). If not, the first cleaning sequence is executed (S314, S316).

By effecting control as in this embodiment, the cleaning sequences can be properly executed even in the case where the sheet width is shorter than the image size width with respect to the axial direction of the photosensitive drum 1, in the case where the sheet width is shorter than the image size width with respect to the sheet feeding direction and in the case where the above-described two cases generated on the same sheet. In this embodiment, as the proper values, values of 1, 5, 10, 20 and 10 are used in steps S305, S307, S309, S310 and S314, respectively, but each of the proper values exists depending on the structure of the image forming apparatus, and therefore, the frequency suitable for the structure of the image forming apparatus may only be required to be set.

In this embodiment, the cleaning sequence counter indicated the degree of the contamination of the charging roller 2 with the toner, but the present invention is not limited thereto. For example, a cleaning sequence counter indicating a degree of contamination of the transfer roller 7 with the toner may also be employed. Further, by using a plurality of cleaning sequence counters, the cleaning sequences may also be executed depending on the degree of contamination of members to be subjected to counting by the cleaning sequence counters.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2015-210512 filed on Oct. 27, 2015, and 2016-151730 filed on Aug. 2, 2016, which are hereby incorporated by reference herein in their entirety.

What is claimed is:

1. An image forming apparatus comprising:

an image bearing member;

a developing device for forming a toner image on said image bearing member by depositing toner on an electrostatic latent image formed on said image bearing member;

a transfer member for transferring the toner image onto a sheet at a transfer portion;

a contact member provided downstream of said transfer member and upstream of said developing device with respect to a movement direction of a surface of said image bearing member and contacting said image bearing member at a contact portion, wherein the surface of said image bearing member passed through the transfer portion reaches the contact portion without being cleaned, a detecting portion for detecting a size of the sheet; and a controller for executing an operation in a cleaning mode for cleaning said contact member, wherein said controller executes the operation in the cleaning mode when said controller discriminates that the size of the sheet detected by said detecting portion is smaller than a size of the toner image.

2. An image forming apparatus according to claim 1, wherein in the operation in the cleaning mode, toner of an opposite polarity to a normal polarity of toner deposited on said contact member is transferred onto said image bearing member and the opposite polarity is changed to the normal polarity by generating electric discharge between said contact member and said image bearing member, and then the toner of the normal polarity is collected in said developing device, wherein when said controller discriminates that the size of the sheet detected by said detecting portion is not less than a size of the toner image, said controller executes an operation in a first cleaning mode for cleaning said contact member, wherein the operation in the cleaning mode executed by said controller in a case where said controller discriminates that the size of the sheet is smaller than the size of the toner image is an operation in a second cleaning mode, wherein cleaning power in the operation in the second cleaning mode is higher than cleaning power in the operation in the first cleaning mode.

3. An image forming apparatus according to claim 2, wherein the operation in the second cleaning mode is longer in execution time than in the operation in the first cleaning mode.

4. An image forming apparatus according to claim 2, wherein in the operation in the second cleaning mode, a potential difference between a surface of said contact member and a surface of said image bearing portion is made larger than that in the operation in the first cleaning mode.

5. An image forming apparatus according to claim 1, wherein the operation in the cleaning mode is executed after an image forming process for forming an image on the sheet is ended.

6. An image forming apparatus according to claim 5, wherein said controller executes an operation in a third cleaning mode before the image forming process is ended when said controller discriminates that the size of the sheet detected by said detecting portion is smaller than the size of the toner image.

7. An image forming apparatus according to claim 6, wherein said controller executes the operation in the third cleaning mode when an image formation sheet number is continuously not less than a predetermined sheet number in the image forming process.

8. An image forming apparatus according to claim 7, wherein said controller executes the operation in the third cleaning mode at timing from after the toner image is transferred onto the sheet until a subsequent toner image is transferred onto a subsequent sheet.

9. An image forming apparatus according to claim 1, wherein said contact member is a charging member for electrically charging said image bearing member.

10. An image forming apparatus according to claim 9, wherein a plurality of charging members are provided as said contact member.

11. An image forming apparatus according to claim 1, wherein said contact member is a roller for removing a foreign matter from said image bearing member.

12. A image forming apparatus according to claim 1, wherein the size of the sheet detected by said detecting portion is a width of the sheet with respect to a direction perpendicular to a feeding direction of the sheet, and the size of the toner image is a width of the toner image with respect to an axial direction of said image bearing member.

13. An image forming apparatus according to claim 1, wherein the size of the sheet detected by said detecting portion is a width of the sheet with respect to a feeding direction of the sheet, and the size of the toner image is a width of the toner image with respect to a direction perpendicular to an axial direction of said image bearing member.

14. An image forming apparatus according to claim 1, wherein in the operation in the cleaning mode, toner of an opposite polarity to a normal polarity of toner deposited on said contact member is transferred onto said image bearing member and the opposite polarity is changed to the normal polarity by generating electric discharge between said contact member and said image bearing member, and then the toner of the normal polarity is collected in said developing device.

15. An image forming apparatus according to claim 14, further comprising a discharging unit provided downstream of the transfer portion and upstream of the contact portion with respect to said image bearing member and configured to discharge said image bearing member, wherein during execution of the operation in the cleaning mode, electric discharge is generated between said contact member and a surface of said image bearing member discharged by said discharging unit.

16. An image forming apparatus comprising:

an image bearing member;

a developing device for forming a toner image on said image bearing member by depositing toner on an electrostatic latent image formed on said image bearing member;

a transfer member for transferring the toner image onto a sheet at a transfer portion;

a contact member provided downstream of said transfer member and upstream of said developing device with respect to a movement direction of a surface of said image bearing member and contacting said image bearing member at a contact portion, wherein the surface of said image bearing member passed through the transfer portion reaches the contact portion without being cleaned, a detecting portion for detecting a size of the sheet; and a controller for executing an operation in a cleaning mode for cleaning said contact member, wherein a size of the sheet detected by said detecting portion is a width of the sheet with respect to a feeding direction of the sheet, and a size of the toner image is a width of the toner image with respect to a direction perpendicular to an axial direction of said image bearing member, wherein when said controller discriminates that the size of the sheet detected by said detecting portion is smaller than the size of the toner image, said controller executes the operation in the cleaning mode.

17. An image forming apparatus according to claim 16, wherein in the operation in the cleaning mode, toner of an opposite polarity to a normal polarity of toner deposited on said contact member is transferred onto said image bearing member and the opposite polarity is changed to the normal polarity by generating electric discharge between said contact member and said image bearing member, and then the toner of the normal polarity is collected in said developing device.

18. An image forming apparatus according to claim 17, further comprising a discharging unit provided downstream of the transfer portion and upstream of the contact portion with respect to said image bearing member and configured to discharge said image bearing member, wherein during execution of the operation in the cleaning mode, electric discharge is generated between said contact member and a surface of said image bearing member discharged by said discharging unit.

19. An image forming apparatus according to claim 18, wherein in the operation in the cleaning mode, toner of an opposite polarity to a normal polarity of toner deposited on said contact member is transferred onto said image bearing member and the opposite polarity is changed to the normal polarity by generating electric discharge between said contact member and said image bearing member, and then the toner of the normal polarity is collected in said developing device, wherein when said controller discriminates that the size of the sheet detected by said detecting portion is not less than a size of the toner image, said controller executes an operation in a first cleaning mode for cleaning said contact member, wherein when the operation in the cleaning mode executed by said controller in a case where said controller discriminates that the size of the sheet is smaller than the size of the toner image is an operation in a second cleaning mode, cleaning power in the operation in the second cleaning mode is higher than cleaning power in the operation in the first cleaning mode.

20. An image forming apparatus according to claim 19, wherein the operation in the second cleaning mode is longer in execution time than in the operation in the first cleaning mode.

21. An image forming apparatus according to claim 20, wherein in the operation in the second cleaning mode, a potential difference between a surface of said contact member and a surface of said image bearing portion is made larger than that in the operation in the first cleaning mode.

22. An image forming apparatus according to claim 16, wherein the cleaning mode is executed after an image forming process for forming an image on the sheet is ended.

23. An image forming apparatus according to claim 22, wherein said controller executes an operation in a third cleaning mode before the image forming process is ended when said controller discriminates that the size of the sheet detected by said detecting portion is smaller than the size of the toner image.

24. An image forming apparatus according to claim 23, wherein said controller executes the operation in the third cleaning mode when an image formation sheet number is continuously not less than a predetermined sheet number in the image forming process.

25. An image forming apparatus according to claim 24, wherein said controller executes the operation in the third cleaning mode at timing from after the toner image is transferred onto the sheet until a subsequent toner image is transferred onto a subsequent sheet.

26. An image forming apparatus according to claim 16, wherein said contact member is a charging member for electrically charging said image bearing member.

27. An image forming apparatus according to claim 26, wherein a plurality of charging members are provided as said contact member.

28. An image forming apparatus according to claim 16, wherein said contact member is a roller for removing a foreign matter from said image bearing member.

* * * * *